US006283171B1

(12) United States Patent
Blake

(10) Patent No.: US 6,283,171 B1
(45) Date of Patent: Sep. 4, 2001

(54) METHOD FOR PROPELLANT FILLING AN AEROSOL CONTAINER WITH A LARGE AEROSOL ACTUATOR BUTTON ON THE VALVE DURING FILLING AND ACTUATOR BUTTON THEREFOR

(75) Inventor: Robert R. Blake, Cuernavaca (MX)

(73) Assignee: Precision Valve Corporation, Yonkers, NY (US)

( * ) Notice: Subject to any disclaimer, the term of this patent is extended or adjusted under 35 U.S.C. 154(b) by 0 days.

(21) Appl. No.: 09/264,050

(22) Filed: Mar. 8, 1999

(51) Int. Cl.[7] ..... B65B 1/04
(52) U.S. Cl. ..... 141/20; 141/3; 222/402.16
(58) Field of Search ..... 141/3, 20; 222/402.1, 222/402.13, 402.16

(56) References Cited

U.S. PATENT DOCUMENTS

| | | | | |
|---|---|---|---|---|
| 3,122,180 | * | 2/1964 | Abplanalp | 141/20 |
| 3,319,669 | * | 5/1967 | Abplanalp | 141/20 |
| 4,463,784 | * | 8/1984 | Butcher et al. | 141/20 |
| 4,915,266 | * | 4/1990 | Knicherbocker | 222/402.16 |
| 5,881,929 | * | 3/1999 | Coerver, Jr. | 222/402.16 |

* cited by examiner

*Primary Examiner*—Steven O. Douglas
*Assistant Examiner*—Khoa D. Huynh
(74) *Attorney, Agent, or Firm*—Kilgannon & Steidl

(57) ABSTRACT

A method for filling an aerosol container with propellant, wherein an enlarged button actuator (button having a diameter base of at least fifteen millimeters) having a discharge orifice communication with a socket for receiving the hollow valve stem of an aerosol valve, an annular wall radially outward of the socket for sealing on a pedestal of a valve mounting cup and a sealing surface on the outer wall for mating with a propellant filling head, and at least one conduit communicating a chamber defined, in part, by the annular wall sealing on the pedestal and a chamber defined by the interior of the filling head and the outer surface of the button is employed. The method provides a system for propellant filling of the container with the button on the stem of the associated valve coupled to the aerosol container opening. The method steps involve securing an aerosol valve to the can opening, mounting the enlarged actuator button on the valve stem of the aerosol valve, advancing a filling head to a sealing relation to the outside of the enlarged button actuator and concomitantly sealing the annular wall to the pedestal, and introducing pressurized propellant through the filling head.

3 Claims, 2 Drawing Sheets

METHOD FOR PROPELLANT FILLING AN AEROSOL CONTAINER WITH A LARGE AEROSOL ACTUATOR BUTTON ON THE VALVE DURING FILLING AND ACTUATOR BUTTON THEREFOR

This invention refers or relates to a method for filling valved aerosol containers with propellant, wherein a large actuator button is in place on the container during the propellant filling and a large actuator button for said method.

BACKGROUND OF THE INVENTION

In the usual aerosol container, product and propellant are placed in a valved container. The aerosol valve includes a valve stem which emerges through the pedestal portion of the container closure or mounting cup. An actuator is frictionally fitted to the valve stem; the actuator being the component that receives manual pressure from the user of the aerosol container to actuate or open the valve and, thereby, to cause egress of the container contents. Actuators are often of the type referred to as aerosol button actuators. Examples of such button actuators are set forth in U.S. Pat. Nos. 4,463,784; 3,122,180; 3,319,669 and 4,915,266. Actuator buttons generally come in two sizes, a normal size wherein the circumference of the button on the stem is substantially the same or slightly larger than the circumference of the pedestal portion of the mounting cup. A second size is an enlarged button actuator wherein the circumference of the bottom of the actuator extends considerably beyond the circumference of the pedestal portion.

In a normal size actuator button, it is common to dispose the actuator on the valve stem before crimping the valve to the pedestal portion of the mounting cup. In the instance of an enlarged actuator button, the button cannot be disposed on the valve stem prior to crimping the valve to the pedestal for reason that the enlarged diameter of the base of the actuator forecloses positioning the crimping tools within the well of the mounting cup defined by the pedestal and the body of the mounting cup.

There are two principal methods for filling an aerosol container with propellant, namely, the "under-the-cup" and "pressure filling."

More and more, the aerosol industry is resorting to "pressure filling" of the container with propellant rather than "under the cup" filling. The reasons are to diminish the loss of costly propellants and to minimize emission of propellant into the atmosphere. In under-the-cup filling, a filling head actually lifts the mounting cup partially out of the mouth of the aerosol container and the propellant is driven under pressure through the opening between the bead (opening) of the container and the channel or circular skirt of the mounting cup; the clinching of the mounting cup and the bead of the container being accomplished in the same operation after completion of the propellant filling.

With pressure filling of the propellant, the valve and its associated mounting cup are affixed to the container in a sealed relationship prior to the introduction of the propellant to the container. Pressure filling is accomplished by having a filling head advance against the peripheral flange on the actuator button which depresses the button so that the bottom of the button seals against the pedestal portion of the mounting cup, that is, the raised portion of the mounting cup through which the valve stem of the aerosol valve extends. The propellant enters the container around the stem and through the opening in the pedestal. With certain valves, the pressure of the propellant compresses the valve gasket and the principal filling route of the propellant is over the compressed gasket and down through castellated slots in the valve housing which surround the valve stem/valve body. Also, depending on the size of the orifice openings in the valve stem, there is propellant filling through the valve stem orifices, the valve stem being depressed to move the stem orifices into communication with the interior of the container.

Heretofore, in the instance where an enlarged aerosol actuator button has been utilized, the practice has been to clinch a valve bearing mounting cup to the container, then pressure fill the container with the enlarged actuator removed from the valve stem and subsequently assemble the enlarged actuator on the valve stem.

In the course of assembling the enlarged actuator to the valve stem, and particularly in the instance where the valve is an aerosol tilt valve, there is the opportunity for premature discharge of container contents. Thus, it is desirable to place the enlarged actuator button on the valve stem prior to filling the container with propellant.

It is an object of this invention to provide a method for the propellant filling of a valved aerosol container with an enlarged actuator in place on the valved aerosol container prior to filling the container with propellant.

It is a further object of this invention to provide an actuator button suitable for carrying out the method of this invention.

SUMMARY OF THE INVENTION

For purposes of this specification and the claims hereto, reference to an "enlarged aerosol actuator" or an "enlarged actuator button" shall mean that the base of the enlarged actuator shall have a diameter of at least 15 millimeters.

The method of this invention comprises the steps of:

(1) crimping, in a sealed relation, an aerosol valve to the pedestal portion of a mounting cup;

(2) clinching, in a sealed relation, said mounting cup to the bead of an aerosol container, thereby providing a hermetically sealed aerosol container when the aerosol valve is in the closed position;

(3) disposing on the valve stem an enlarged aerosol actuator having a means for sealing the actuator on the pedestal and having propellant filling passages therethrough;

(4) subsequently advancing a propellant filling head toward the enlarged actuator and thereby sealing the filling head on an outside surface of the enlarged actuator and sealing the enlarged actuator against the pedestal portion of the mounting cup; and (5) charging propellant through the filling head.

In a preferred embodiment of the method of this invention, steps 3 and 4 above comprise:

(3) disposing on the valve stem an enlarged aerosol actuator having a downwardly and outwardly sloping shoulder on the outer base portion of the actuator and further having an annular ring portion radially inward of the sloping shoulder and disposed so as to be in axial alignment with the pedestal portion of the mounting cup.

(4) subsequently advancing a propellant filling head in a sealing relation against the sloping shoulder to advance the actuator toward the container and, thereby, sealing the annular ring portion against the pedestal portion of the mounting cup.

The enlarged actuator button of this invention has a base having a diameter at least 15 millimeters. Extending from the base is an outer wall which merges into a top portion. Surrounding the base is a peripheral abutment and disposed radially inward of the peripheral abutment is an annular sealing rib which has an axial alignment so as to seat on the pedestal portion of the mounting cup of an aerosol container when the actuator button is seated on the valve stem. Propellant filling passages traverse the actuator button from a point above the peripheral abutment to within the sealing rib. As with prior art actuator buttons, the button has a socket for receiving the valve stem of an aerosol valve, a discharge orifice and conduits connecting the socket to the discharge orifice.

In a preferred embodiment of the enlarged actuator button is an actuator button for an aerosol tilt valve. In said actuator button, the button components discussed above are likewise present. Additionally, the peripheral abutment forms the base of the actuator button, which abutment merges into an outer inwardly tapered wall, said wall having a recess for a discharge orifice insert. On the opposite side of the outer wall from the recess, the outer wall is shaped to receive the pad of the user's finger. The preferred actuator button has an annular downwardly projecting rib that terminates at its sealing edge in a plane substantially the same as the upper terminus of the peripheral abutment. Also, the socket of the preferred actuator button communicates with the recess in the outer wall and these are two propellant charging passages, the upper terminus of which is in the finger pad-shaped outer surface of the actuator button.

DETAILED DESCRIPTION OF THE INVENTION

Figure 1:
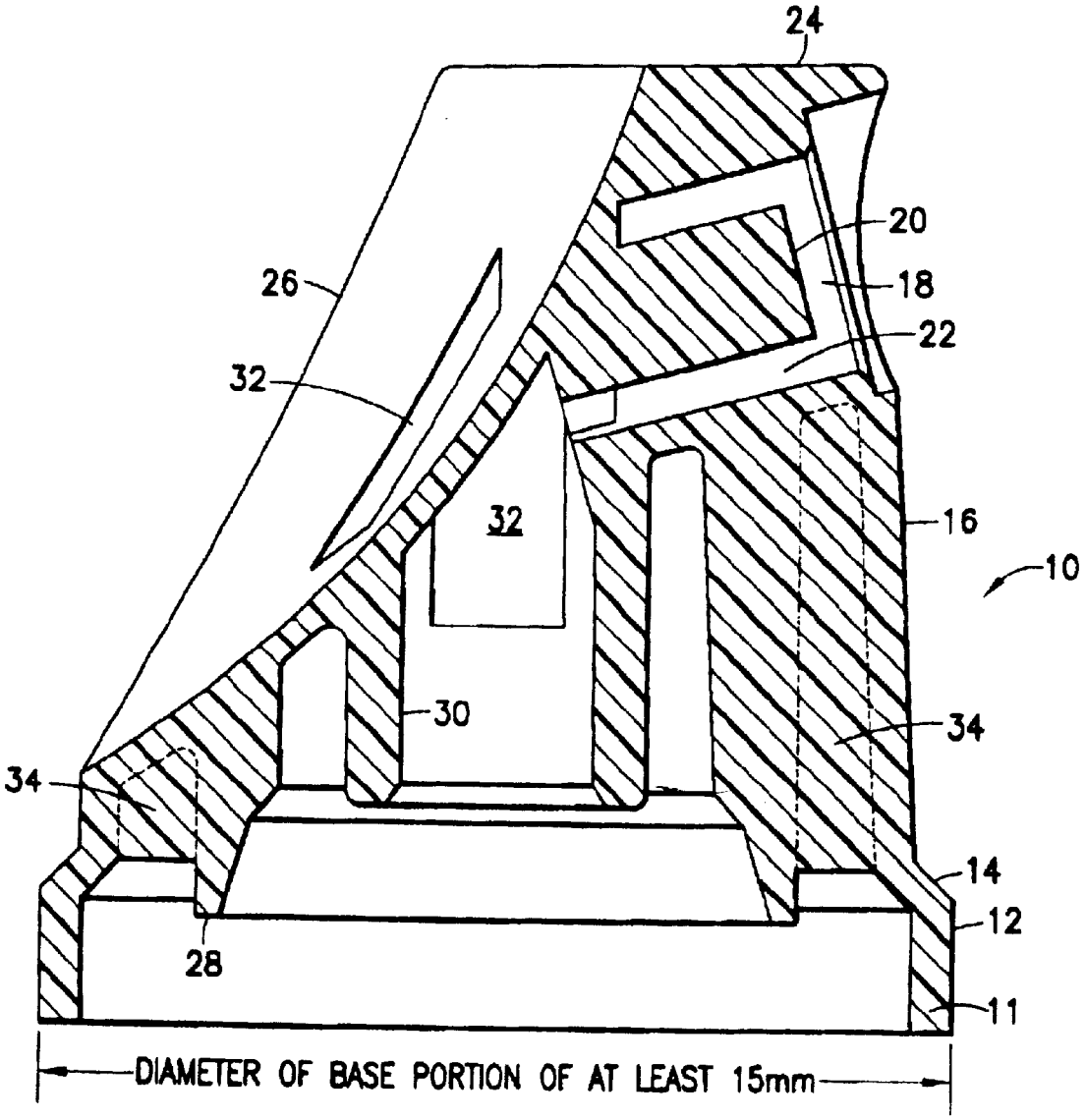
FIG. 1 is a cross-sectional view of an enlarged actuator button of this invention.

In FIG. 1 is shown an enlarged actuator, generally designated as 10, comprising a base having a peripheral depending wall 12, said wall 12 terminating at its upper end in a shaped shoulder 14, which shoulder 14 acts as a peripheral abutment to receive the propellant filling head. Extending from the shoulder 14 is an outer wall 16 having in its upper front portion a recess 18 having an outer face 20. An annular duct 22 extends inwardly from the recess 18. The recess receives an insert (not shown) having the discharge orifice of the button. The outer wall 16 at its upper terminus merges into a top portion 24. The rear portion 26 of the outer wall 16 is contoured to receive the finger pad of the user. Radially inward of the depending wall 12 is an annular downwardly extending rib 28, which rib acts to form a hermetic seal with the pedestal portion of a mounting cup (not shown) during propellant filling. Radially inward of the rib 28 is a socket 30, which socket 30 receives the valve stem of an associated valved aerosol container (not shown). The conduit 32 defined by the socket 30 communicates at one terminus with the conduit in the valve stem and at its other terminus with the annular duct 22. Slot 32 provides a propellant conduit between the outer surface of the actuator button 10 and the interior of the actuator button within the confines of the sealing rib 28. Additional slots may be provided. Reinforcing ribs 34 are disposed between the peripheral depending wall 12 and the sealing rib 28. Reinforcing ribs may also be provided between the outer wall of the socket 30 and the sealing rib 28.

Figure 2:
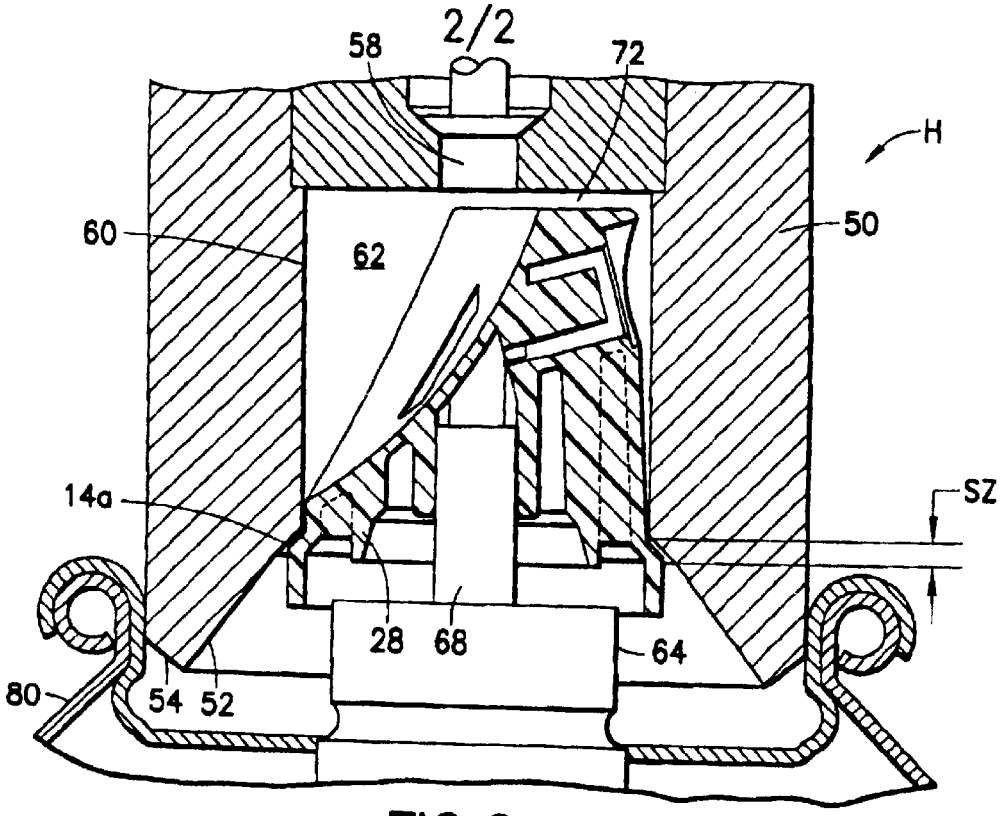
FIG. 2 is a vertical central section through a portion of an aerosol container with the pedestal portion of the mounting cup and valve stem shown in elevation, having an enlarged actuator button on the valve stem in central section and cooperating portions of a charging head also in central section, the parts being shown in assembled relation and in non-charging propellant relation.
Figure 3:
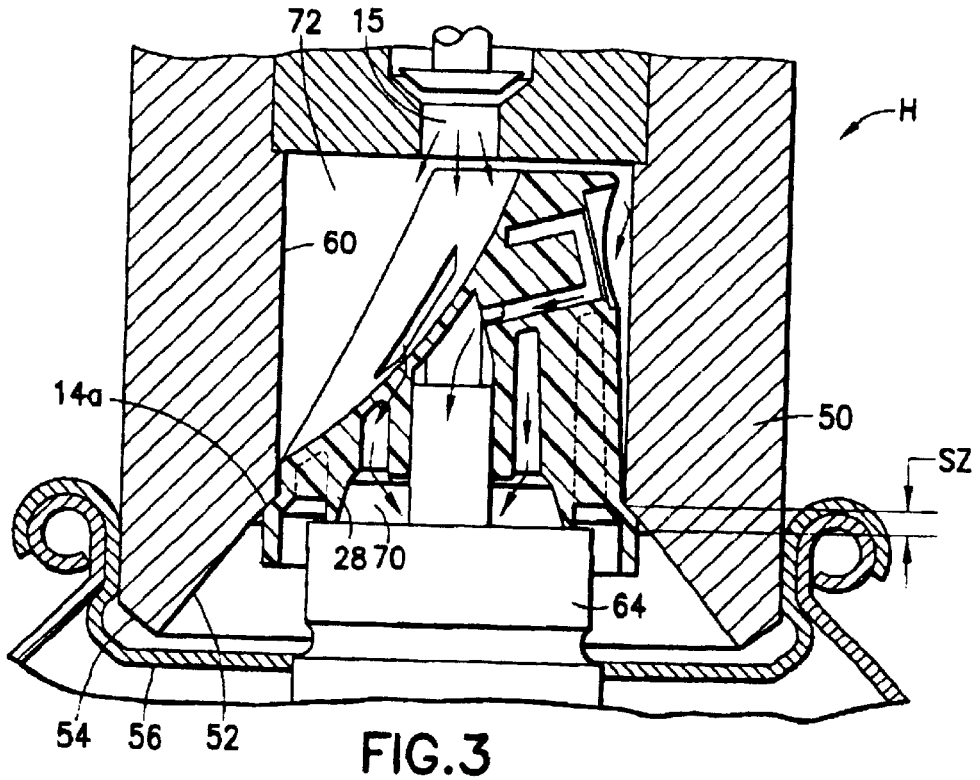
FIG. 3 is like unto FIG. 2, but shows the parts in propellant charging relation.

In FIG. 2 is shown a propellant filling head, generally designated as H, comprising a tubular portion 50 for receiving the actuator button 10, said tubular portion 50 having a cylindrical portion 60 terminating in a downwardly and outwardly sloping portion 14*a*, the surface of which conforms to the shoulder 14 of the actuator button 10, so that, when the filling head is lowered, the interior surface of the sloping portion 14a will engage with the shoulder 14 and form therewith an annular sealing zone SZ, as shown in FIGS. 2 and 3.

Below the surface 14*a*, the tubular part 50 is flared outwardly, as shown at 52 to provide proper clearance and also serve to center the can with respect to the filling head H. The outer surface of the tubular part 50 may also be tapered, as at 54, to assist in centering the parts by contact with the mounting cup 56 although the lower end of the tubular part 50 should not contact the base of said cup 56. Except in the particulars stated, the filling head H is conventional. As usual, it is provided with a charging passage 58 with an suitable valve (not shown) to control the flow of propellant therethrough into a chamber 62 which will hereinafter be referred to as the upper chamber.

The annular rib 28 at the bottom of the button 10 is adapted, when the button is depressed into charging position, to engage with the surface of the pedestal 64 and, being of yielding plastic material, form through such engagement, a tight seal with said pedestal.

The slot 32 provides a passageway for the propellant fed through the passage 58 of the charging head H.

In carrying out the method of this invention, according to the showing of FIGS. 2 and 3, an aerosol can 80 containing an active ingredient is positioned in cooperative relation with a filler head H and the filler head and can brought into the relative position shown in FIG. 2. At this time the valve of the container is closed.

The parts are then moved from the position of FIG. 2 to the position of FIG. 3 to cause the surface 14*a* of tubular portion 50 to be pressed firmly against the upper surface of the shoulder 14 at the sealing zone SZ. As this movement continues, the button 10 is depressed, carrying with it the valve stem 68 until the annular sealing rib 28 engages the surface of the pedestal to form with the latter a hermetic seal for a lower chamber or enclosure 70. By that time, there will be two hermetic seals produced, namely, between the rib 28 and the pedestal 64 and between the surface 14*a* and the surface of the shaped shoulder 14, so that the upper and lower chambers 62 and 70 are sealed with respect to the atmosphere.

Further, slight downward movement of the filler head will depress the valve stem 68 sufficiently to open its associated can valve and thus establish communication between the interior of the can and the passage 58 of the filler head. It is essential that these seals be made before the valve of the filler head is open to permit the feed of propellant under pressure through the passage 58.

As soon as the valve propellant valve of the filling head is open, propellant under pressure will be fed into the chamber 62. At the same time, thus fed propellant will pass from the chamber 62 downwardly through the slot 32 into the small chamber or enclosure 70 formed between the rib 28 and the surface of the pedestal 64 and within the confines of the annular rib 28.

As a result, the propellant is fed from the upper chamber 62 along two distinct courses. It will flow through the discharge outlet (not shown) and the chamber and passages of the button to the interior passage of the valve stem and through this passage downwardly to and through the open valve into the can. At the same time, propellant will be fed from the upper chamber through ducts to the lower chamber and from there downwardly around the outer surface of the valve stem and through the clearing space between the valve stem and the pedestal and then downwardly through the open valve into the interior of a can. Consequently, there is a feed of the propellant into the can both through the interior of and about the interior of the valve stem in order to effect rapid charging. Many valves are so constructed as to permit this type of filling, but with very considerable waste of propellant ashereinbefore stated.

The relatively small volumetric capacity of the chambers 62 and 70 is noted. These chambers contain at any time a very small quantity of propellant and consequently there is very little propellant contained therein to be vented to the atmosphere at the conclusion of the charging operation.

After the can has been charged in the manner described, the valve of the charging head is closed and the charging head H is raised or the can lowered, as the case may be. As this operation occurs the valve of the can is first closed and, as it is closed, the valve stem is lifted along with the push button until the parts reassume the position of FIG. 2. Thereafter continued elevation of the filler head or lowering of the can moves the push button and can from within the confines of the filler head and the can may be removed and is ready for the market. As noted above, a very small quantity of propellant contained in the chamber 62 and 70 will, of course, vent out as the filler head and can are separated, but because of the small volumetric capacity of these chambers, a negligible amount of propellant is lost. This is in pronounced contradistinction to prior practice as hereinbefore stated.

In the button shown in FIGS. 2 and 3, the slots 32 extend from the upper surface to the lower surface of the button. However, in practice, the only requisite for the positioning of these slots is that they connect the upper and lower chambers 72 and 70, respectively, above and below the sealing zone. These slots may thus occupy many positions so long as they meet that criteria.

Although specific examples of the invention have been shown for purposes of disclosure, it is to be understood that various modifications can be made therefrom without departing from the spirit and scope of the invention.

I claim:

1. A method of pressure filling a valved aerosol container having a bead defining its opening, said valve including a mounting cup having a pedestal portion and a valve stem extending through an aperture in the pedestal portion comprising:

(a) crimping, in a sealing relation, an aerosol valve to the pedestal portion of the mounting cup;

(b) subsequently, clinching in a sealing relation, said mounting cup to the bead of an aerosol container, thereby providing a hermetically sealed aerosol container when the aerosol valve is in the closed position;

(c) disposing on the valve stem an enlarged aerosol actuator having a socket with an upper and lower terminus for receiving the valve stem, said actuator further having an annular rib disposed radially outward from the socket and extending beneath the lower terminus of the socket, an outer annular base wall having a diameter of at least fifteen millimeters radially outward from the rib and extending below the annular rib, the upper terminus of said base wall merging into an upwardly and inwardly sloped sealing surface, the lower terminus of the annular rib extending below the sloped sealing surface; the actuator further having propellant filling passages therethrough, a top actuating surface for receiving the finger of the user, a discharge orifice and a conduit communicating the discharge orifice and the socket;

(d) subsequently advancing a propellant filling head toward the enlarged actuator thereby sealing the filling head on the sloped sealing surface of the enlarged actuator button and sealing the annular rib of the enlarged actuator against the top surface of the pedestal portion of the mounting cup; and (e) charging propellant through the filling head.

2. An enlarged aerosol actuator button for actuating and discharging container contents through an aerosol valve disposed in a pressurized container, said aerosol valve having a valve stem emerging from the pedestal portion of a mounting cup comprising a socket for receiving the valve stem in a friction fit relationship; the socket having an upper and lower terminus, said actuator further having an annular rib disposed radially outward from the socket and extending below the lower terminus of the socket, an outer annular base wall being at least fifteen millimeters in diameter disposed radially outward from the annular rib and extending below the annular rib, said outer base wall having an upper and lower terminus, the upper terminus of the outer base wall merging into an upwardly and inwardly sloped outer sealing surface having an upper and lower terminus, the lower terminus of the sloped outer sealing surface being in a horizontal plane above the lower terminus of the annular rib, an upstanding outer wall extending from the upper terminus of the sloped outer sealing surface, said upstanding outer wall having a top surface, the actuator further having a discharge orifice, a conduit communicating the socket and the discharge orifice and at least one propellant charging conduit extending from outside the button through the button to within a chamber defined in part by the annular rib.

3. The enlarged actuator of claim 2, and further wherein the discharge orifice is disposed in a side of the outer wall and the opposite side of the outer wall has a finger-shaped recess wherein is disposed the opening in the outer wall.

* * * * *